United States Patent [19]

Davis

[11] 4,098,403

[45] Jul. 4, 1978

[54] BEVERAGE CARRIER

[75] Inventor: Paul Davis, Swampscott, Mass.

[73] Assignee: Sweetheart Plastics, Inc., Wilmington, Mass.

[21] Appl. No.: 752,409

[22] Filed: Dec. 20, 1976

[51] Int. Cl.[2] ..... B65D 21/02; B65D 81/26; B65D 25/10

[52] U.S. Cl. ..... 206/519; 206/203; 220/23.8

[58] Field of Search ..... 206/203, 515, 519, 520; 220/23.8

[56] References Cited

U.S. PATENT DOCUMENTS

| | | | |
|---|---|---|---|
| 3,142,407 | 7/1964 | Popupitch | 206/203 |
| 3,944,109 | 3/1976 | Holz | 229/2.5 R |
| 3,991,879 | 11/1976 | Hirota | 206/203 |

*Primary Examiner*—George E. Lowrance
*Attorney, Agent, or Firm*—Wolf, Greenfield & Sacks

[57] ABSTRACT

A cup carrier having a band made of resilient plastic material and having a plurality of cup engaging sections, each of which is intended to surround more than half the circumference of a cup. A web for supporting the cups from the bottoms is suspended beneath the band by a plurality of downwardly converging strips. The carrier is nestable with other identical carriers.

7 Claims, 6 Drawing Figures

BEVERAGE CARRIER

INTRODUCTION

This invention relates to beverage carriers and more particularly comprises a very inexpensive, disposable beverage carrier particularly suitable for use in fast food establishments.

In fast food establishments carriers for beverages, sandwiches and like foods are essential to enable an individual to conveniently carry away from the serving counter food for a number of people. Such establishments have used disposable cardboard trays designed to carry several drinks along with several sandwiches or hamburgers. The cardboard trays include several shallow pockets that engage the bottoms of the beverage cups and also include a central tray section for the sandwiches and hamburgers. Those trays are not designed to carry only drinking cups. Furthermore, they lack the rigidity required to firmly grip the cups, and they are particularly unsuitable for holding tall containers. In addition, they must also be assembled by the counter attendant as they are shipped as flat blanks and do not nest when set up.

Paper bags are frequently used for drinks alone. They are unsuitable for they do not hold the cups firmly against tilting, they are inconvenient to handle, they do not immediately reveal leaking cups to the user, and they tear easily.

One important object of this invention is to provide an inexpensive carrier suitable for carrying a number of cups simultaneously.

Another important object of this invention is to provide an inexpensive cup carrier which has the versatility of being suitable for use with a variety of different size containers.

Yet another important object of this invention is to provide a cup carrier which is fully erected and requires no folding operation on the part of the user but which nevertheless does store in a confined space.

To accomplish these and other objects the cup carrier of this invention is injection molded as a unitary structure having a top band made up of several cup engaging sections, each of which is resilient and designed to engage more than half the circumference of a cup mounted in it. Disposed beneath the band is a web carried by several strips which extend downwardly from the band. Each cup engaging section, because of its flexible character, can be spread to accommodate cups of a larger diameter than normally described by the molded cup engaging section. The strips which support the web converge in a downward direction so that identical carriers may be nested with one another in closely spaced relationship.

These and other objects and features of this invention will be better understood and appreciated from the following detailed description of two embodiments thereof, selected for purposes of illustration and shown in the accompanying drawing.

BRIEF FIGURE DESCRIPTION

DETAILED DESCRIPTION

Figure 1:
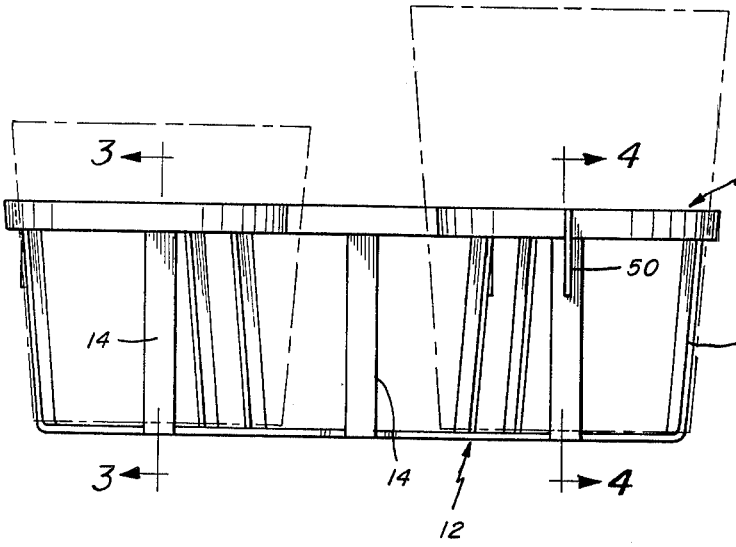
FIG. 1 is a side view of a cup carrier constructed in accordance with this invention and suggesting cups of different size in place in it.
Figure 2:
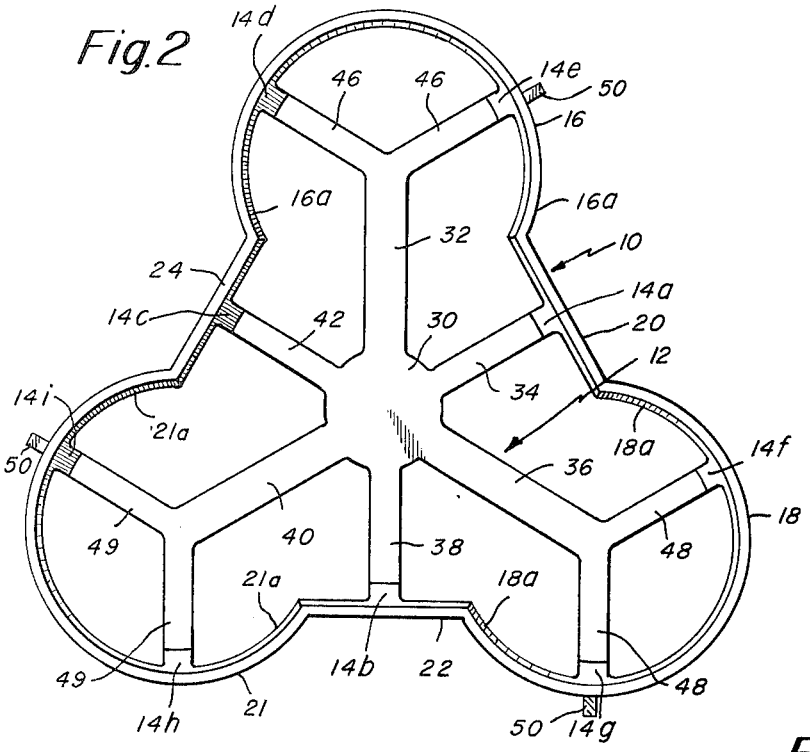
FIG. 2 is a plan view of the cup carrier.

The carrier shown in FIGS. 1–4 includes an upper band 10, a bottom web 12, and a plurality of side strips 14 that join the band 10 and web 12. The band, web and strips are integrally molded from inexpensive plastic material such as high impact polystyrene or polypropylene.

The band 10 in the embodiment shown is composed of three cup engaging sections 16, 18 and 21, joined together at their ends by three connecting sections 20, 22 and 24. Each cup engaging section is arcate in shape and describes an arc of approximately 240°. Consequently, each band is of sufficient circumferential extent to engage more than half the circumference of the side wall of a cup placed in it. Because the two ends of each cup engaging section (16*a*, 18*a* and 21*a*) are essentially free of restraints, they may be flexed outwardly from their normal molded and unstressed configuration so as to accomodate cups of larger diameter placed within them.

The connecting sections 20, 22 and 24 are of sufficient lengths so as to space the cup engaging sections far enough apart to allow for substantial rim and lid diameters. It will be appreciated that cups are ordinarily tapered so that their rims are substantially larger in diameter than their bottoms, and to enable cups to be placed wthin each of the cup engaging sections, the sections must be spaced apart so as to accomodate the cup taper.

The web 12 includes a central hub 30 from which six arms 32, 34, 36, 38, 40 and 42 radiate. The arms 32, 36 and 40 extend in the direction of the center of curvature of each of the cup engaging sections while the other arms 34, 38, and 42 extend in the direction of the centers of the connecting sections of the band. Strips 14*a*, 14*b* and 14*c* connect the ends of the arms 34, 38 and 42, respectively to the connecting sections 20, 22 and 24, respectively. The ends of arms 32, 36 and 40 are connected each to a pair of arms 46, 48, and 49 respectively, that in turn are connected to the band by strips 14*d*, 14*e*, 14*f*, 14*g*, 14*h* and 14*i*. The arms 46, 48 and 49 are coplanar with the six arms 32, 34, 36, 38, 40 and 42 that radiate from the hub 30.

As is evident in the drawings, each of the nine strips 14*a* through 14*i* are inclined downwardly and inwardly from the band 10. This configuration enables the carrier to be nested with other identical carriers as suggested in FIG. 4. And there are no handles on the carrier to interfere with the nesting. To support the carriers in nested configuration without binding upon each other, stacking flanges 50 are molded into strips 14*e* and 14*i*. The flanges each have a lower supporting edge 52 which engages the upper surface 54 of the band of the next lower carrier in the stack as is evident in FIG. 4. Thus, as shown in that figure, the upper carrier A has a stacking flange 50 mounted on the strip 14*g* and whose bottom edge 52 rests on the upper edge 54 of the band of the lower carrier B. Therefore, while the carriers nest closely with one another, stacking flanges 50 prevent the carriers from jamming. As is evident in FIG. 1, three such flanges are provided, spaced equidistantly about the carrier so as to provide a stable support for each carrier on the next lower one in the stack.

Figure 3:
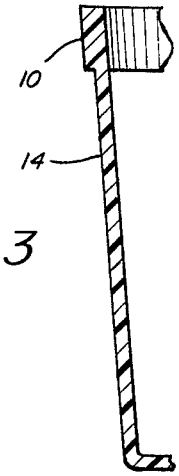
FIG. 3 is a fragmentary cross sectional view of the carrier taken along the section line 3—3 of FIG. 1.
Figure 4:
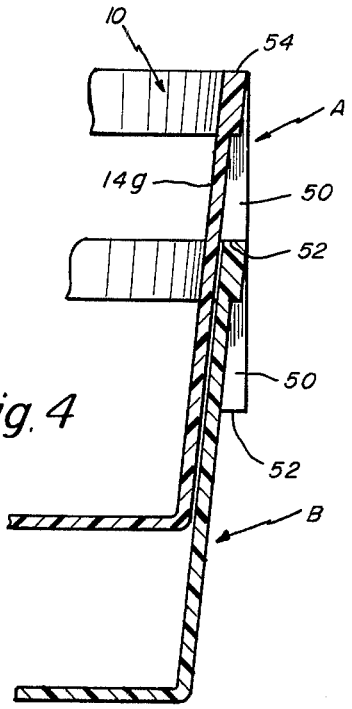
FIG. 4 is a fragmentary cross sectional view of a pair of identical carriers nested together, the section taken along the section line 4—4 of FIG. 1.

The band 10 is shown in FIGS. 3 and 4 to be thickened to lend strength to the carrier. However, although the band is thicker than the strips 14, there is no shoulder or lip formed at their juncture which could catch on the bottom of a cup when it is being placed in the carrier to spill the cup contents or which could interfere with carrier nesting.

Figure 5:
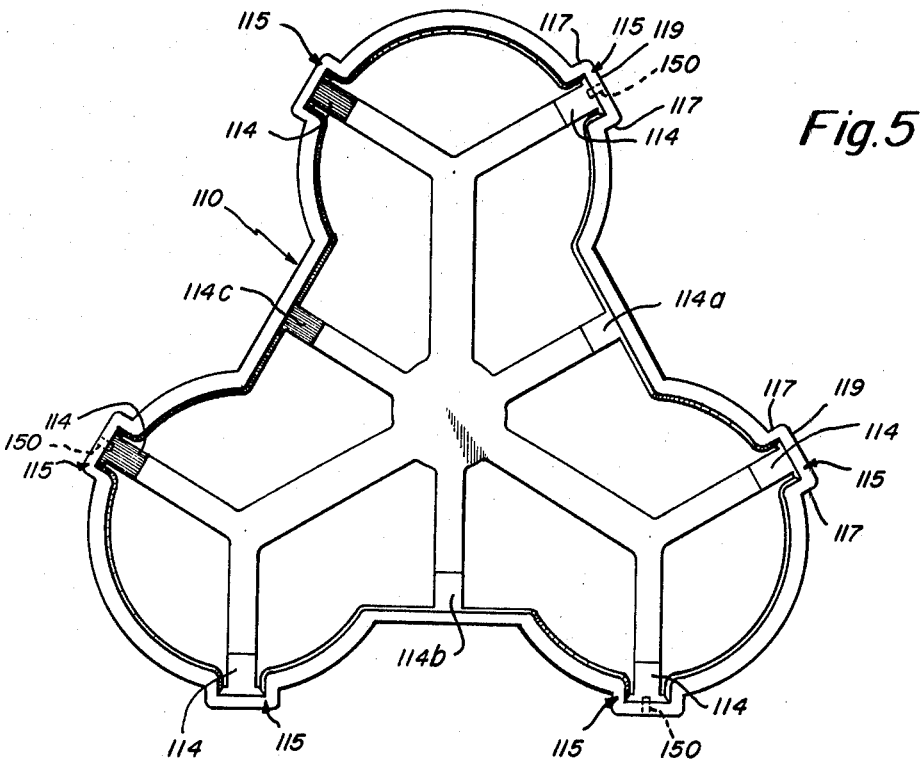
FIG. 5 is a plan view similar to FIG. 2 of the preferred embodiment of this invention.

In the embodiment of FIGS. 1–4, the strips 14 are inclined at an angle of approximately 5° to the vertical. That angle plus the stock thickness determines the closeness of the nest pitch when the carriers are stacked one in the other. For certain applications it may be very important to minimize the stack height in which case the angle of the strips to the verticalmust be increased. In the preferred form of this invention shown in FIGS. 5 and 6, the angle of the strips 114 has been increased to approximately 10°, and to accommodate that angle, offsets 115 are provided in the top band 110 where the tops of the strips attach to it. If the offsets were not provided, either the radii of each cup section at the band web or the vertical extent of the carrier would have to be changed. But those dimensions are dictated by the size of the cups to be received by the carrier and may not be altered. The offsets 115 in this embodiment are generally U-shaped and are defined by sides 117 and base 119. They do not in any way interfere with the use of the carrier in supporting the cups. In other respects the carrier is the same as that of FIGS. 1–4. It may be noted that no offsets are provided at the tops of strips 114*a*, 114*b* and 114*c*, as their spacing at the web does not effect the capacity of the carrier.

Figure 6:
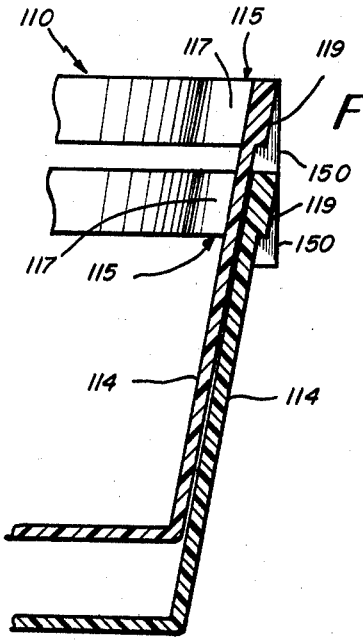
FIG. 6 is a fragmentary cross sectional view of a pair of nested carriers identical to that shown in FIG. 5.

In FIG. 6, two such carriers with offsets at the band are shown, and the nesting of the carriers is obviously much closer than in the embodiment shown in FIG. 4. The angle of the strips is approximately 10° to the vertical and the vertical extent of the stacking flanges 150 has been reduced.

From the foregoing description it will be appreciated that in the illustrated embodiments, three separate cups may be carried in the carriers. And because of the flexibility of the band at the cup engaging sections, cups of different sizes may be readily accommodated. One such carrier may be sized to carry everything from a 7 ounce cup to a tall 22 ounce cup. The web 12 is flat, which enables the carrier to stand firmly on a support and also provides a firm support for the bottom of each cup placed in the carrier. The spacing of the arms of the web 12 as well as the strips 14 prevents the cups from falling out the sides or the bottom of the carriers. And the arrangement of the arms of the web conforms with good injection molding practice by allowing the molten plastic material in the mold during molding to flow evenly throughout the cavity. The gate in the embodiments shown would conventionally be provided at the center of hub 30, and the wider arms 32, 36 and 40 of the web permit the molten material to flow freely to the extreme portions of the cavity.

It will also be appreciated that because of the open configuration of the carriers, any leaks in or spillage from the cups will be readily detected. This is an advantage over the conventional paper bags frequently used for drinks, which hide leaks or spillage until the bags are too weak to hold the cups, and tear.

From the foregoing description those skilled in the art will appreciate that numerous modifications may be made of this invention without departing from its spirit. Therefore, I do not intend to limit the breadth of this invention to the specific embodiments illustrated and described. For example, it is apparent that the carriers may be made with different numbers of cup engaging sections without departing from the spirit of this invention. Consequently, the scope of this invention is to be determined by the appended claims and their equivalents.

What is claimed is:

1. A cup carrier comprising an upper band adapted to engage the side walls of a plurality of cups intermediate their tops and bottoms, said band forming at least two cup engaging sections each being generally arcuate in shape and having an angular extent of more than 180° so as to surround more than half the circumference of the cup, said cup engaging sections being flexible to enable the sections to be flexed outwardly to effectively increase their diameter so that they may receive any one of a plurality of different cups of a diameter greater than the normal diameter of each section, a plurality of strips connected and extending downwardly from spaced points on the band, a web connected to the strips for supporting the bottoms of cups in the carrier, said band, strips and web being integrally molded of a plastic material, and said strips converging in a downwardly direction enabling identical carriers to be nested with the band, strips and web of one carrier being disposed in close proximity to the band, strips and web of another carrier.

2. A cup carrier as described in claim 1 further characterized by said band also having connecting sections which join the cup engaging sections to form an endless loop.

3. A cup carrier as described in claim 2 further characterized by said band having three cup engaging sections connected together by straight connecting sections.

4. A cup carrier as described in claim 2 further characterized by at least two strips extending downwardly from each cup engaging section and being arcuately spaced apart less than 180°.

5. A cup carrier as described in claim 3 further characterized by stacking means connected to certain of the strips adjacent their top for engaging the top of the band of an identical carrier when the carriers are nested together, to prevent jamming of the carriers.

6. A cup carrier as described in claim 2 further characterized by each cup engaging section being approximately 240° in circumferential extent, the connecting sections of the band being straight.

7. A cup carrier as described in claim 1 further characterized by outwardly extending offsets provided in the band at the cup engaging sections, and certain of said strips being connected to the band at the offsets.

* * * * *